United States Patent [19]

Cala et al.

[11] 4,196,095

[45] Apr. 1, 1980

[54] DRY BLENDING USING MAGNESIUM STEARATE

[75] Inventors: Francis R. Cala, North Brunswick; Anthony E. Winston, East Brunswick, both of N.J.

[73] Assignee: Church & Dwight Co. Inc., New York, N.Y.

[21] Appl. No.: 923,630

[22] Filed: Jul. 11, 1978

[51] Int. Cl.[2] ..... C11D 3/08; C11D 3/10; C11D 3/12

[52] U.S. Cl. ..... 252/140; 252/135; 252/156; 252/174.14; 252/174.21; 252/174.25; 252/363.5; 252/383; 252/384; 252/385; 252/540

[58] Field of Search ..... 252/89, 91, 134, 140, 252/174, 156, 160, 383, 384, 385, 363.5, 174.14, 174.21, 174.25, 540

[56] References Cited

U.S. PATENT DOCUMENTS

| | | | |
|---|---|---|---|
| 2,069,710 | 2/1937 | Missbach | 252/385 X |
| 2,288,409 | 6/1942 | Lippman | 252/383 X |
| 2,288,410 | 6/1942 | Lippman | 252/384 X |
| 2,539,012 | 1/1951 | Diamond | 252/384 X |
| 2,589,330 | 3/1952 | Bradford | 252/385 X |
| 2,932,556 | 4/1960 | Stephanou | 252/384 X |
| 3,179,588 | 4/1965 | Siimes | 252/384 X |
| 3,925,226 | 12/1975 | Takenouchi | 252/92 |
| 3,954,649 | 5/1976 | Lamberti | 252/174 |
| 4,016,041 | 4/1977 | Van Kampen | 252/384 X |

*Primary Examiner*—Dennis L. Albrecht

*Attorney, Agent, or Firm*—Cushman, Darby & Cushman

[57] ABSTRACT

Magnesium stearate is added to dry blended detergent or detergent additive compositions in order to disperse the compositions in wash water and prevent the formation of large insoluble lumps when the formulation is used in cold washing water, generally below 75° F. The formulations also include a major proportion of one or more unhydrated or partially hydrated hydratable detergent builder salts, at least half of which is sodium carbonate, together with up to 30% by weight of a synthetic detergent active compound or mixture of such compounds.

3 Claims, No Drawings

DRY BLENDING USING MAGNESIUM STEARATE

This invention is directed to and describes dry blended laundry detergents and detergent additives, typically of the home use type, containing unhydrated or partially hydrated hydratable salts. As a class, the carbonate-base laundry detergents and detergent additives may be mentioned. These products perform well and have been widely sold and accepted. However, when used in cold water (for example, wash water temperatures of 75° F. or less), such dry blended detergents and detergent additives based upon or containing unhydrated or partially hydrated hydratable salts tend to form lumps in the wash water which are only slowly soluble. As a result, efficacy may be lost since the active ingredients are not fully in solution. In addition, lumps may sometimes be present at the completion of the washing process, giving cause for user concern.

The dry blending approach to detergent manufacture is distinct from and is advantageous over the spray drying procedure as it is more convenient and requires less total energy to produce a final product. The capital investment for dry blending equipment is also significantly lower than that required for spray drying.

We have discovered that when a stearate salt, which is itself substantially water insoluble, is included in a dry blended detergent formulation of the type described, the resulting product exhibits a greatly reduced tendency to form large insoluble lumps and is thus attractive to the consumer who wishes to use cold water in the washing procedure.

Detergent formulations and additives based upon hydrated or partially hydrated hydratable salts, typically the carbonates, are themselves well known. Such products will contain from 15 to 90% by weight of sodium carbonate or similar salt and have an overall non-surfactant component content in the general range of about 70 to about 90% by weight.

The detergent formulations and detergent additives of our invention may include one or more synthetic detergent active compounds, builder salts which may be carbonate or builder phosphates, oxidizing agents such as percarbonates or perborates and the usual detergent formulation ingredients such as perfume, brighteners, anti-redeposition agents, soil-suspenders, fillers (such as sodium sulfate) and the like, all as described in detail below. These novel formulations are characterized by the presence of an amount of a metal salt of a fatty acid which prevents lump formation in cold water. The metal ion is any di- or trivalent ion capable of forming an insoluble salt with a long chain of fatty acid. Typical metals include aluminum, calcium, magnesium and zinc. As the long chain fatty acid moiety a carbon atom chain length of greater than $C_{12}$ is used, generally not exceeding $C_{22}$, illustrative materials being the stearates, palmitates, myristates, laurates, tallowates, and cocoates, including mixtures of two or more of such fatty acids. Preferably the insoluble fatty acid salt is magnesium stearate, used in an amount sufficient to achieve the desired anti-lumping action and in the range of from about 0.1 to about 2% by weight of the total formulation.

For a detergent additive composition a surfactant may or may not be necessary. For a fully formulated laundry detergent a surfactant is essential.

As the surfactant component of a laundry detergent formulation, one can use one or more of many suitable synthetic detergent active compounds which are commercially available and described in the literature, for example, in "Surface Active Agents and Detergents", Volumes 1 and 2 by Schwartz, Perry and Berch. Several detergents and synthetic detergent active compounds are also described in the following United States Patents, the relevant disclosures of which are hereby incorporated by reference: U.S. Pat. Nos. 3,957,695; 3,865,754; 3,932,316, and 4,009,114. Generally stated, the detergent component may include a synthetic anionic, noionic, amphoteric or zwitterionic detergent active compound, or mixtures of two or more of such compounds.

We prefer to use a mixture of nonionic and anionic detergent compounds. The preferred water soluble anionic detergent compounds are the alkali metal (such as sodium and potassium) salts of the higher linear alkyl benzene sulfonates. The particular salt will be suitably selected depending upon the particular formulation and the proportions therein.

The sodium alkylbenzenesulfonate detergent (LAS) most preferably used in the composition of the present invention has a straight chain alkyl radical of average length of about 11 to 13 to carbon atoms. The preferred anionic detergent compound is linear sodium dodecylbenzenesulfonate (LAS).

Specific nonionic detergent active compounds which can be used in the compositions of the present invention include ethoxylated fatty alcohols, preferably linear primary or secondary monohydric alcohols with $C_{10}$–$C_{18}$, preferably $C_{12}$–$C_{15}$, alkyl groups and about 3–15, preferably 7–12, ethylene oxide (EO) units per molecule, and ethoxylated alkylphenols with $C_8$–$C_{16}$ alkyl groups, preferably $C_8$–$C_9$ alkyl groups, and from about 4–12 EO units per molecule. The nonionic compounds mentioned above are often used in admixture with amounts of other detergent active compounds, especially anionic compounds, to modify the detergency, soil redeposition, lather characteristics, powder and physical properties of the overall formulation.

The preferred class of nonionic detergent active compounds are the ethoxylated linear alcohols, such as the $C_{12}$–$C_{15}$ alcohols ethoxylated with an average of from about 3 to about 12 moles of ethylene oxide. A most preferred nonionic detergent is a $C_{12}$–$C_{15}$ alcohol ethoxylated with 7 moles of ethylene oxide.

For a laundry detergent, the effective amount of the detergent active compound or compounds of the present invention is generally in the range of from about 5 to about 30% by weight and preferably from about 5 to about 15% by weight of the composition. The choice of a particular detergent active compound or mixture of compounds will, of course, vary but within the stated ranges. For a laundry additive, such as a powdered dry bleach, the presence of a detergent active is optional. Frequently, however, 1 to 5% detergent active is included in these formulations.

As the builder component, the detergent formulations of the present invention include inorganic unhydrated or partially hydrated hydratable salts typically used in dry blended detergent formulations. They include the water-soluble, inorganic detergency builder salts of alkali metal carbonates, tripolyphosphates, pyrophosphates, hexametaphosphates and silicates. Specific examples are the sodium and potassium carbonates and tripolyphosphates. Generally, at least one third of the detergent formulation is anhydrous sodium carbonate (soda ash) or sodium tripolyphosphate. Detergent additive products often contain much higher levels. Sodium silicate is usually present in the 5 to 10% range to decrease the possibility of corrosion of metal parts in fabric washing machines. Other detergent builders may be present in minor amounts.

Apart from the detergent active compounds and detergency builders, a detergent composition of the present invention can contain any of the conventional additives in the amounts in which such additives are normally employed in fabric washing detergent compositions. Examples of these additives include lather boosters such as alkanolamides, particularly the monoethanolamides derived from palm kernal fatty acids and coconut fatty acids, lather depresants, anti-redeposition agents, such as sodium carboxymethylcellulose, oxygen-releasing bleaching agents such as sodium perborate and sodium percarbonate, peracid bleach precursors, chlorine-releasing bleaching agents such as trichloroisocyanuric acid and alkali metal salts of dichloroisocyanuric acid, fabric softening agents, inorganic salts such as sodium sulphate, and usually present in very minor amounts, fluorescent agents, perfumes, enzymes such as proteases and amylases, germicides and colorants.

Detergent additive compositions according to the present invention contain specific components necessary to perform the additive function desired. For example, dry bleaches will contain oxygen or chlorine releasing agents such as the isocyanurates, perborates, persulphates or percarbonates. Water conditioning additives will contain tripolyphosphates, carbonates, citrates or other water softening agents. Other detergent ingredients, as are described for detergents, may also be included in these additive compositions.

We have found that among the preferred surfactants there exists an optimum surfactant blend between the linear sodium dodecylbenzene sulfonate (LAS) and the $C_{12}$–$C_{15}$ alcohol ethoxylated with 7 moles of ethylene oxide nonionic surfactant. Expressed on a weight basis the ratio is 1:1.

The detergent or detergent additive compositions may be dry blended in any suitable type of blending equipment, e.g., a ribbon blender, Paterson Kelly twin cone blender or V-shell blender. If desired, liquid components may be oversprayed through nozzles onto the dry blend while mixing.

The magnesium stearate may be incorporated into the product before or after the liquid components. Although it is preferable to add magnesium stearate as a dry powder, it may also be dissolved in a suitable solvent such as nonionic and sprayed onto the product.

Alkyl benzene sulfonate, if used, may be added as a pre-dried flake or, in the acid form, it may be neutralized in situ to form the acid salt.

EXAMPLES OF THE INVENTION

The following examples are illustrative of the invention. For convenience in presentation, LAS is linear sodium dodecylbenzenesulfonate; the nonionic surfactant is ethoxylated linear alcohol ($C_{12}$–$C_{15}$); Neodal 25-3 is a $C_{12}$–$C_{15}$ alcohol ethoxylated with 3 moles of ethylene oxide and Neodol 25-7 is a $C_{12}$–$C_{15}$ alcohol ethoxylated with 7 moles of ethylene oxide. The Neodol ingredients are nonionic surfactants manufactured by Shell Chemical Company.

In the following description, examples in accordance with the present invention are numbered and comparative examples, not in accordance with the present invention, are lettered. Unless otherwise indicated, all parts and percents are by weight.

EXAMPLE I—washing machine test results

This example demonstrates the efficiency of magnesium stearate in preventing insoluble lump formation in cold water with a detergent formulation containing unhydrated sodium carbonate. The washing machine tests consist of putting 150 grams of laundry detergent into a small pile on the bottom of the tub of a dry washing machine. A 5-pound load of fabrics is then added to the washing machine. The machine is then started, allowed to fill up and run through complete wash and rinse cycles. At the end of the final rinse cycle, any remaining detergent is retrieved from the washing machine and weighed. The water temperature was 62° F. The dry blended detergent formulations used were as follows:

| Control Formulation | |
|---|---|
| LAS | 3% |
| Neodol 25-3 | 6% |
| Sodium Silicate (hydrous)* | 6.7% |
| Sodium Bicarbonate | 5.7% |
| Sodium Sesquicarbonate | 18% |
| Sodium Carbonate | Balance |
| Perfume, brighteners, anti-redeposition agents | 0.85% |

| Magnesium Stearate Formulation | |
|---|---|
| LAS | 3% |
| Neodol 25-3 | 6% |
| Sodium Silicate (hydrous)* | 6.7% |
| Sodium Bicarbonate | 5.7% |
| Sodium Sesquicarbonate | 18% |
| Magnesium Stearate | 1% |
| Sodium Carbonate | Balance |
| Perfume, brighteners, anti-redeposition agents | 0.85% |

*Philadelphia Quartz's C-24 silicate with $SiO_2/Na_2O$ ratio of 2.4

The weight of insoluble lumps isolated at the end of the final rinse cycle were as follows:

| Run | | Weight (grams) |
|---|---|---|
| A | | 34.4 |
| B | | 18.2 |
| C | | 48.9 |
| | Control Average | 33.3 |
| 1 | | 0 |
| 2 | | 0 |
| 3 | | 0.2 |
| | Invention Average | 0.1 |

As magnesium stearate is itself insoluble in water, its demonstrated ability to retard detergent lump formation in dry-blended carbonate-based detergent formulations in cold water is truly unexpected.

EXAMPLE II—lab beaker test

In this example, the effect of magnesium stearate in dry-blended detergent formulations was studied. We observed that the presence of magnesium stearate in the formulation enables the room temperature water to lift up the detergent and break it apart thus facilitating dispersion of the product.

According to this procedure, 2.5 grams of a given detergent formulation are placed in a corner of a 2 liter -continued

| | Control | MgS/Neodol 25-3 Formulation | MgS/Neodol 25-7 Formulation |
|---|---|---|---|
| agents | 0.55 | 0.55 | 0.55 |
| Sodium Carbonate | Balance | Balance | Balance |

The washing machine test used a standard Maytag washing machine with a water temperature of 56° F. The procedure is described in Example I, except that 160 g of detergent was used. The weight in grams of insoluble lumps isolated at the end of the washing machine rinse cycle were as follows:

| Run # | Control | MgS/Neodol 25-3 Formulation | MgS/Neodol 25-7 Formulation |
|---|---|---|---|
| 1 | 47.6 | 0 | 2.6 |
| 3 | 28.2 | 4.0 | 3.9 |
| 3 | 34.3 | 0.3 | 1.2 |
| 4 | 16.7 | 1.0 | 0.6 |
| 5 | 31.9 | 1.3 | 3.6 |
| Avg. | 31.7 | 1.3 | 2.4 |

With the exception that the water temperature was 45° F. rather than 70° F., the lab beaker test was run according to the procedure of Example ii. The weight of the detergent in grams recovered after five minutes was as follows:

| Run # | Control | MgS/Neodol 25-3 Formulation | MgS/Neodol 25-7 Formulation |
|---|---|---|---|
| 1 | 2.0 | 1.1 | 0.7 |
| 2 | 2.5 | 1.4 | 1.5 |
| 3 | 2.1 | 0.3 | 0.2 |
| 4 | 2.3 | 0.5 | 0.6 |
| 5 | 2.2 | 1.3 | 0.2 |
| Avg. | 2.2 | 0.9 | 0.6 |

What is claimed is:

1. In a dry blended carbonate-based detergent or detergent additive composition containing, in weight percent of the composition, from about 30 to 90% by weight of an unhydrated or partially hydrated hydratable detergent builder salt, at least one third of said composition being sodium carbonate, from about 5 to about 10% by weight of sodium silicate, and from 5 to about 30% by weight of a synthetic anionic, nonionic, amphoteric or zwitterionic detergent active compound, the improvement comprising including in said composition a dispersing amount of from 0.1 to about 2% by weight of magnesium stearate.

2. In a dry blended, carbonate-based detergent composition containing in percent by weight of the composition, from about 30 to about 90% by weight of an unhydrated or partially hydrated hydratable detergent builder salt, at least half of said builder salt being sodium carbonate, and from 5 to about 30% by weight of a synthetic anionic or nonionic detergent active compound or mixtures thereof, the improvement comprising including a dispersing amount of magnesium stearate in said composition in the range of from about 0.1 to about 10%.

3. A dry blended, carbonate-based detergent said composition containing, in percent by weight of the composition, from about 30 to about 90% by weight of an unhydrated or partially hydrated hydratable detergent builder salt, at least half of said builder salt being sodium carbonate, from 5 to about 15% by weight of a synthetic anionic or nonionic detergent active compound or mixtures thereof, and a dispersing, lump preventing amount of magnesium stearate in said composition in the range of from about 0.1 to about 10%.

* * * * *